United States Patent [19]

Chang

[11] Patent Number: 4,844,969

[45] Date of Patent: Jul. 4, 1989

[54] ORTHOPEDIC BED STRUCTURE

[76] Inventor: James L. Chang, 289 Lake Ave., Saratoga Springs, N.Y. 12866

[21] Appl. No.: 45,866

[22] Filed: May 4, 1987

[51] Int. Cl.[4] ..... A47C 19/00; D06C 7/02

[52] U.S. Cl. ..... 5/186 R; 5/431; 26/51; 28/165; 28/167; 66/170; 66/195; 66/202; 428/229; 428/230; 428/81; 428/193; 432/8

[58] Field of Search ..... 428/229, 230; 5/186 R, 5/431; 26/51; 28/165, 167; 432/8

[56] References Cited

U.S. PATENT DOCUMENTS

| | | | |
|---|---|---|---|
| 3,682,731 | 8/1972 | Morancy | 428/230 |
| 4,298,643 | 11/1981 | Miyagawa et al. | 428/229 |
| 4,469,738 | 9/1984 | Himelreich | 428/229 |
| 4,469,739 | 9/1984 | Gretzinger et al. | 428/229 |

*Primary Examiner*—James C. Cannon

*Attorney, Agent, or Firm*—Schmeiser, Morelle & Watts

[57] ABSTRACT

A method and apparatus for providing orthopedic sleeping support without utilizing traditional box-spring or spring-in-mattress devices. A specially prepared (by prescription) fabric is stretched between rigid frame support members beyond moduli conventionally employed in the bedmaking industry, but short of the Young's Modulus for the particular composite fibres.

13 Claims, 4 Drawing Sheets

22

ORTHOPEDIC BED STRUCTURE

FIELD OF THE INVENTION

This invention relates generally to orthopedic support structures in the nature of beds and, more particularly to the fabrication and use of elastomeric beds and bedding to accommodate persons having orthopedically prescriptive needs.

BACKGROUND OF THE INVENTION

For many years, beds have been composed of resilient or spring bases on which are placed mattresses composed primarily of fabric envelopes containing soft, spongy innards. In some instances, the base (hereinafter referred to as box-spring) and mattress have been combined; in others, the box-spring has been eliminated and the mattress placed on a firm, unyielding surface.

The use of cots, as a temporary expedient, essentially embodied the principles of the aforementioned and more traditional bed/bedding structures. But, since cots are for only temporary setup and cannot (because they are constructed for limited purposes) be generally employed for orthopedic prescriptive means, they shall no longer be considered as falling within the subject genre.

Floatation sleeping apparatus, namely the waterbed, has successfully provided orthopedic support means and is utilized by many whose requirements cannot be successfully accommodated by the traditional box-spring and/or mattress. But, flotation equipment is often heavy, bulky and relatively immobile. It requires special water treatment, as well as heating means and water-escape prevention mechanisms.

Retreating to the traditional box-spring and mattress then, as a means of providing prescriptive orthopedic therapy, we are faced with their inherent defects and disadvantages. The standard bed has employed springs for decades. The spring gives a constant rate of loading under increasing stress. Therefore, under differing loads the spring will extend or compress to different lengths which, in the assembled device, would equate to different depths of depression. Arbitrarily speaking, a man weighing 400 pounds would compress the spring four inches; whereas, a man weighing 100 pounds would compress it to one inch. This loading characteristic makes the spring ill-suited as a mechanism for orthopedic support where one desires to avoid such linearity.

Another disadvantage to the use of the spring is the high labor cost involved in building a wood frame, placing hundreds of springs in the frame, adding padding to insulate the springs from an outer covering and using an expensive textile fabric to provide the envelope covering the entire structure. Further, no matter how many springs are used, or how closely they are packed, there will be space between them. This condition suggests that the standard bed (boxspring or composite mattress) does not give complete support to the body.

Finally, the volume occupied by the traditional box spring and mattress is quite large. In fact, the larger beds (double, queen-sized, king-sized) are often as immobile and spaceconsuming as flotation beds.

I have devised an orthopedic support structure for use as a bed which clearly avoids the aforementioned disadvantages. First, my invention will provide orthopedic support and can be fabricated to prescription. That is, since an orthopedic bed is to provide a certain degree of supportive therapy, depending upon the weight and mass of the person reposing thereon, it inculcates a variable in its manufacture that may be adjusted to specific situations. Rather than attempting to devise a spring that does not have the usual spring limitations, I have eliminated the spring altogether. Having eliminated the spring, I have eliminated also its bed trappings, i.e., connecting wires or ties, padding and envelope which are so necessary in the construction of a box-spring/mattress. My invention is simple in construction, requires low volume of space, may be easily moved, and has the added advantage of being noiseless when subjected to heavy body weights or undue twisting and turning.

For purposes of clarification, although the instant disclosure will be readily understood by those of ordinary skill in the art, certain definitions shall be established and a brief discussion of certain fibers and their desireability for use in the invention shall be explained.

One of the first terms that the reader will encounter in this disclosure is "heat set" as applied to synthetic fibers. Heat setting is a process by which a certain characteristic is achieved. It is a physical change in a synthetic fiber characterized by the formation of a crystaline region and gives the fabric, of which the fiber is a part, better dimensional stability. By the process, fabric engineers are able to obtain desired stress/strain characteristics for a particular fiber.

Certain fibers of the aforementioned "heat set" class are known as "thermoset" fibers in that they can be repeatedly set and reset according to the aforementioned process. This is achieved by heat setting this type of fiber to a different configuration by subsequent application of temperatures higher than that used to achieve the (first or) previous heat set. The polyesters comprise a generic set of "thermoset" fibers.

"Thermoplastic" fibers, for example Nylon, Lycra and acetate, are fibers that become plastic under certain heat conditions (point of plasticity being the Young's Modulus, wherein the fiber will not return to its original form). For every different fabric, testing has to be done to determine its heat setting conditions. Heat set temperatures commonly used in the textile industry for the fibers under discussion are as follows:

polyester—350 to 425 degrees Farenheit (F)
Nylon 66—400 (F)
Nylon 6—385 (F)
acetate—385 (F) DuPont Corporation's Trademark
Lycra *—385 (F) for polyurethane fiber Fiber of two entirely different polymers are used in the construction of the invention, one set being polyurethene, and the other set being polyester, polyamide or other synthetic fiber. Polyester fiber is known as "thermoset", while polyurethane, polyamide, polypropylene and acetate are referred to as "thermoplastic". Polyurethane fiber has higher stretch, power and better elasticity characteristics; polyester and polyamide fibers give a fabric better dimensional stability and are less expensive than polyurethane. Thermoplastic fibers are characterized by Nylon (polyamide), Lycra (polyurethane) and cellulose triacetate, a regenerated cellulose fiber, and are generically characterized by the quality that they may be set only once The thermoset fibers are best illustrated by the trademarked products Dacron, Fortrel and Kodel (polyester).

Other terms known to those versed in the art are "weft" and "Warp-knitting" as opposed to "weaving"; all which refer to the method of constructing a fabric. Knitting, using the warp technique, permits higher precision in fabric engineering and gives a better and more balanced stretch in both warp and weft directions Warp-knitting allows higher productivity with the added advantage that the fabric will not fray i.e., the yarn cannot be unravelled at the edges.

The advantages of the invention are set forth in part herein or shall be obvious herefrom and may be learned by practice with the invention.

SUMMARY OF THE INVENTION

The present invention, inculcating the aforementioned advantages, comprises a method of engineering elastomeric fabric to be used for constructing an orthopedic bed, as well as the means for applying such a fabric to a frame by utilizing a special stretching technique and which establishes its functional mode.

The fabric comprises thousands of loops made of elastomeric fiber interlocked with each other so as to provide support to every part of the human body reposing on it. The fabric is a warp-knitted material composed of a synthetic yarn e.g. polyamide, polyester, polypropylene, acetate, and a Spandex yarn such as polyurethane. Generally, a standard, dual guide bar knitting machine is employed to create a composite fabric of the aforesaid materials in the standard locknit or Tricot stitch, warp knitted stitched both of which are ravel resistant. Specific fabric engineering techniques and the deniers of the yarns will be selected to give the modulus and support for different weights and figures of the person (or persons) who will use such orthopedic bed means. For example, in a double-size bed or larger, one half can be engineered to support a person of 250 pounds, while the other half to support a person of half that weight.

In knitting the fabric, one guide bar of the machine is threaded with synthetic yarn and the other is threaded with a Spandex yarn, as referred to above. The lapping movement of the two guide bars-which will result in the desired knit is given in FIGS. 1 and 2; and will be readily understood by those familiar with the knitting art.

The elastic fabric is then scoured and finished on a tenter frame at the heat set temperature, say for polyester and polyurethane fibers (Spandex),in order to stabilize the composite fabric at the dimensions (to be determined by prescription) for different requirements in moduli, for both comfort and support of the user.

The finished elastic fabric, now termed POWER (TM) brand fabric, is stretched, laid on a table and pinned, with pins Penetrating along the edges to control the shape of the fabric. After the requisite number of layers of the POWER (tm) brand fabric are laid and pinned on the table, they are stretched to the dimension of the bed size desired (or for which it was designed). The amount of stretch and dimension depends on bed size and degree of support prescribed. In the preferred embodiment, holes are punched one inch inside the table pins, approximately six inches apart along the hem of the fabric. Metal grommets are attached through each hole so that when the fabric is stretched to a framework it will not be torn. Finally, the fabric is edge-cut and hemmed. A simple bed frame made of channel steel bars provides the final form to which the fabric is stretched and attached. Since the fabric has been suitably engineered for a specific purpose ( as well as framed), its attachment to the frame will effect stretching to a point just before Young's Modulus is encountered. It is at this fiber extension point that the inventor achieves the novelty and specific utility of his invention. A large increase in weight on the stretched fabric will not cause a significant extension of the fabric; and therefore, a more solid support to the body, given differing weights, is achieved. (Cf. FIG. 5; section A of the stress/strain curve for the invention fabric as tested on an IP4 Scott Inclined Plane Tester, under constant rate of loading. For normal use of covering on a standard bed, section B of the curve is selected to give different stretch: support for a desired comfort level. Section C of the curve depicts the stretch that is generally used in the textile apparel industry).

By using ordinary textile material as the main component, POWER (TM) brand fabric can be manufactured in high production rate, but at a much lower cost. By eliminating woodwork and upholstery, as well as additional fabric for padding, etc., the cost of this orthopedic support structure, POWEREST (TM), is greatly reduced and made much more affordable to the general public.

DETAILED DESCRIPTION OF THE DRAWINGS

Figure 1:
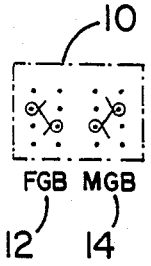
FIG. 1 depicts guidebar movement; 1A depicts the resultant loop structure.
Figure 1A:
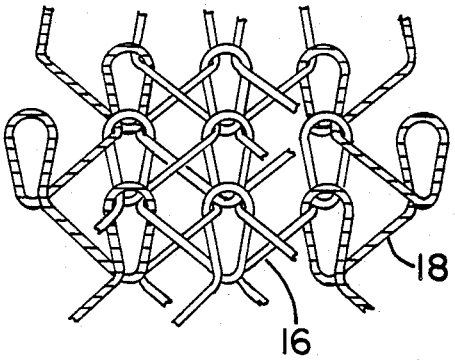

Referring more particularily to FIG. 1, there is depicted a dual guidebar arrangement 10, indicating the lapping movement chosen. The front guidebar (FGB) 12 is threaded with polyester yarn, and the back guidebar (BGB) 14 is threaded with polyurethane fibre. FIG. 1A illustrates the resulting lockknit loop structure which results from the knitted polyester 16 and polyurethane 18.

Figure 2:
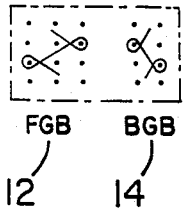
FIG. 2 depicts an alternative guidebar lapping movement and, in FIG. 2A, the resulting loop structure.
Figure 2A:
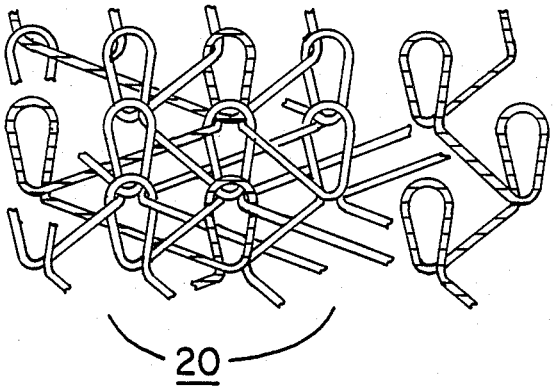

FIG. 2 and FIG. 2A depict essentially the same elements as FIGS. 1 and 1A with the exception that the front guidebar 12 has been "cast-on" to achieve an alternative loop structure 20, as depicted in FIG. 2A.

Figure 3:
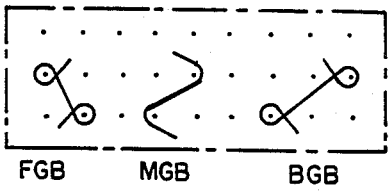
FIG. 3 depicts a 3-guidebar lapping movement and, FIG. 3A the resulting loop structure.
Figure 3A:
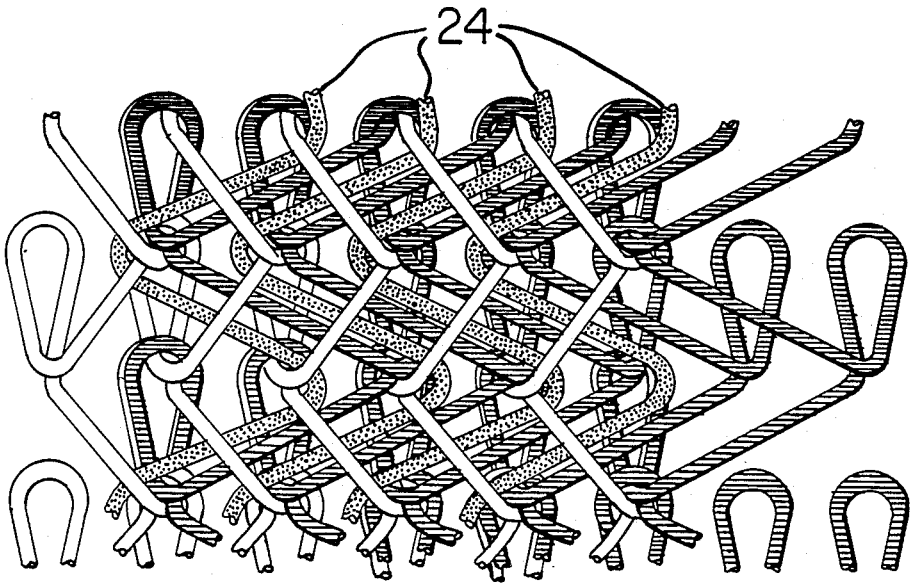

FIG. 3, like the preceding figures, illustrates a lapping movement and resultant pattern (FIG. 3A) utilizing a 3-guidebar machine. In this instance the middle guidebar (MGB) 22 has been cast on with polyurethane fibre 24 to achieve the inlay on lockknit of FIG. 3A.

Figure 4:
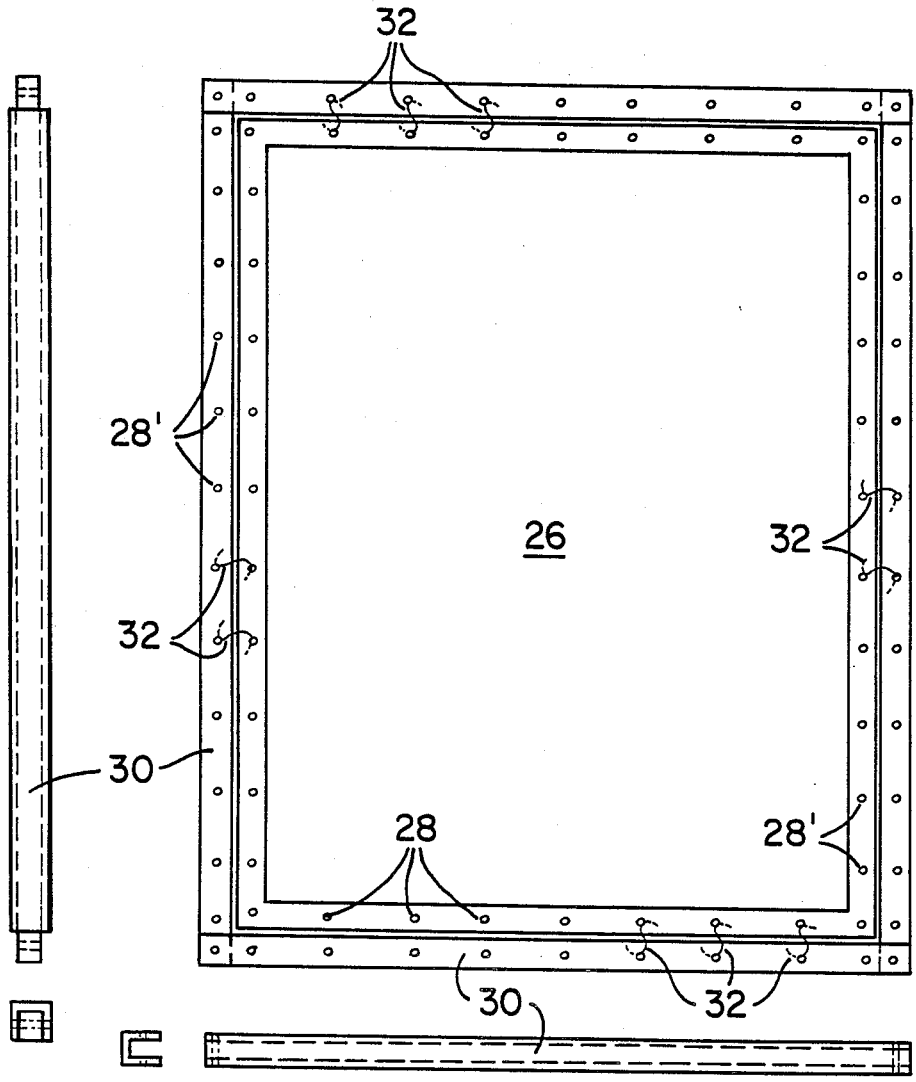
FIG. 4 is an orthographic representation of a bed utilizing the invention.

After the fabric is knitted, it is scoured and run through a tenter frame (not shown) such as may be used in a conventional textile dye house. Thereafter, it is finished at a heat-set temperature in order for the polyester and polyurethane fibres to stabilize at the orthopedic prescriptive (primary) dimension which has been determined in order to afford the proper comfort and support for the person(s) requiring the benefits of this invention. Having constructed the finished fabrics 26, it (or they) must be prepared for final attachment to a rigid frame member. An interim step is accomplished by laying the fabric on a table having pins protruding from the table edges (not shown). A single fabric, or several plies (as required) of the fabric are laid upon and pinned to the table. The fabric is then stretched to the dimension of the prescribed bed size and for which it was designed. Reference to FIG. 4 discloses the holes 28 that are punched in the hem of the fabric for its subsequent attachment to frame 30, at its corresponding holes 28' by the use of steel hooks 32. Frame 30, as may be observed in FIG. 4 is of a simple, rectangular geometry and constructed of channel steel bar.

Figure 5:
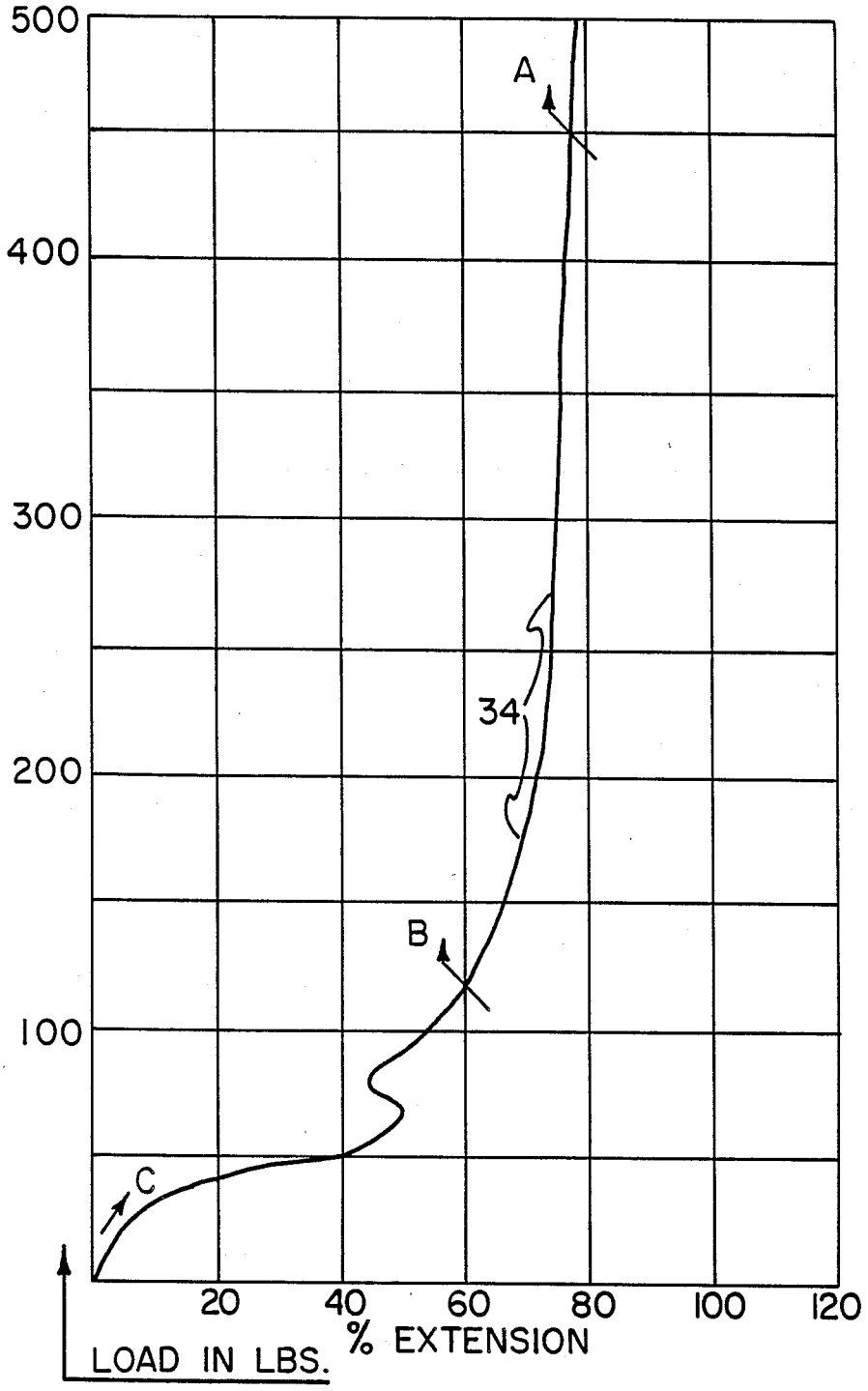
FIG. 5 is a stress/strain curve for a typical engineered fabric made according to the invention.

FIG. 5 is a graphical illustration of a typical, engineered fabric's stress/strain characteristics under constant rate of loading. The vertical margin is graduated in pounds (lbs.) of load, while the horizontal margin is graduated in per cent of extension of the fabric. The stress/strain curve 34 is tri-sectioned into areas A, B and C. For reference, the presumptive deformation point of the fabric (Young's Modulus and here, 80% at 800 lbs.) is not indicated on the graph. Young's Modulus is the point in the stress/strain relationship at which the stretched fiber becomes plastic and will not recover from the stretching. Those familiar with the art will recognize section C as the section of the graph depicting the normal degree of stress that has been applied to a fabric which is to be used in the textile apparel industry. Likewise, Section B will be recognized as that area depicting load-extension relationships which are applied to industrial textiles to achieve a stretch/support ratio for a desired comfort level. And A, is the portion of the curve in which the inventor's preferred embodiment is effected, i.e., at the point or degree of stretch on a polymeric fabric that has been heatset to stabilize that fabric under a particular stress condition. The required stress condition, of course, is that required, to give adequate orthopedic support for a person or persons, as may have been prescribed by a competent medical person.

In its preferred embodiment, this orthopedic elastic mattress is composed of an elastic fabric of approximately one-half inch thickness and results in a technological breakthrough in standard sleeping and resting apparatus; in that, with the elimination of the spring support concept, a suitably engineered elastic textile fabric is employed as a sole means of "spring" support. In its functional mode, it is stretched to the point just before the encounter of Young's Modulus, and a point at which thereafter large increases in weight, applied to the fabric or on the fabric, do not cause any significant extension of the fabric. This allows differing weights of bodies to experience the same degree of solid support and achieves all of the inventor's initial and primary goals.

For example, after the fabric is heat set and manufacture is complete, a graph (here, FIG. 5) is obtained from a stress/strain tester such as the Scott Inclined Plane Tester. In FIG. 5, the fabric stretches 78% under a load of 500 lbs. The fabric has not yet been stretched to its limit, Which is Young's Modulus. That limit, in this case, would be about 80% at 800 lbs. Since, during manufacturing, the fabric is stretched to 60–75% for comfort level, it can be seen that 20–5% stretchability remains under various loads; at Which objects of the invention are achieved.

The invention in its broader aspects is not limited to the singular preferred embodiment shown herein but may be practised in differing embodiments conceiving of differing knit patterns or heat setable yarns or fibres The invention in such broader aspects is limited only by the claims hereinafter made.

What is claimed:

1. The method of making a fabric designed to be useful in the formation of a bearing surface for an orthopedic support comprising the steps of:

warp-knitting a polyurethane fiber with a chemically different synthetic fiber into a fabric.

scouring said fabric; and finishing said fabric under conditions of stretch at a temperature sufficient to heat-set said fabric to stabilize the interknitted fibers thereof at a first desired dimension, the deniers of said polyurethane fiber and said chemically different synthetic fiber having been deliberately selected to provide specific fabric modulus and necessary bearing capacity for the prospective bearing capacity for the prospective users projected for the aforesaid bearing surface when said heat-set fabric is subjected to a second stretching and secured to a framing means.

2. The method of claim 1 wherein said warp-knitting further comprises threading a thermoplastic yarn in the middle or back guide bar of a warp-knitting machine and any other synthetic yarn in the front or back guide bar of said machine.

3. The method of claim 1 wherein said fabric is bi-sectionally fabricated and heat-set so as to accommodate the needs of two persons when said fabric is intended to be used to construct a double bed.

4. The fabric produced by the process of claim 1.

5. The fabric produced by the process of claim 2.

6. The fabric produced by the process of claim 3.

7. The method of making an improved orthopedic bearing surface for providing prescriptive support therapy comprising the steps of:

warp-knitting a polyurethane fiber with a chemically different synthetic fiber into a fabric, the deniers of said polyurethane fiber and said chemically different synthetic fiber having been deliberately selected to provide specific fabric modulus and necessary bearing capacity for the prospective users projected for said bearing surface;

scouring said fabric; and finishing said fabric under conditions of stretch at a temperature sufficient to heat-set said fabric to stabilize the interknitted fibers thereof at a first desired dimension; and subjecting said heat-set fabric to a second stretching to a point just before encounter with the Young's Modulus of the fabric and securing said fabric under second stretching tension to a framing means.

8. The method of claim 7 wherein said warp-knitting further comprises threading a thermoplastic yarn in the middle or back guide bar of a warp-knitting machine and any other synthetic yarn in the front or back guide bar of said machine.

9. The method of claim 7 wherein said fabric is bi-sectionally fabricated and heat-set so as to be able to accommodate the needs of two persons and the support constructed is a double bed.

10. The support produced by the process of claim 1.

11. The support produced by the process of claim 1.

12. The support produced by the process of claim 9.

13. A support produced by a process encompassed by the terms of claim 7 wherein a plurality of fabrics warp-knitted and processed as defined by claim 7 are secured under second stretching tension to a framing means.

* * * * *

UNITED STATES PATENT AND TRADEMARK OFFICE

CERTIFICATE OF CORRECTION

PATENT NO. : 4,844,969

DATED : July 4, 1989

INVENTOR(S) : CHANG, James L.

It is certified that error appears in the above-identified patent and that said Letters Patent is hereby corrected as shown below:

IN THE CLAIMS:

At Claim 1, line 13, delete "for the prospective bearing capacity".

Signed and Sealed this

Eighth Day of May, 1990

*Attest:*

HARRY F. MANBECK, JR.

*Attesting Officer*

*Commissioner of Patents and Trademarks*